United States Patent [19]

Paraghamian et al.

[11] 4,358,275

[45] Nov. 9, 1982

[54] ELECTRONIC REACTION TRAINING APPARATUS

[75] Inventors: Aram C. Paraghamian, Mission, Kans.; Glen F. Long, Richardson, Tex.

[73] Assignee: Reaction Corporation, Mission, Kans.

[21] Appl. No.: 200,280

[22] Filed: Oct. 24, 1980

[51] Int. Cl.[3] ..... G09B 19/00

[52] U.S. Cl. ..... 434/258; 272/DIG. 5

[58] Field of Search ..... 434/258, 247, 228; 272/93, DIG. 5

[56] References Cited

U.S. PATENT DOCUMENTS

| | | | |
|---|---|---|---|
| 1,564,138 | 12/1925 | Rowland | 434/258 |
| 2,260,432 | 10/1941 | Brown | 434/64 |
| 2,678,692 | 5/1954 | Ranseen | 434/258 |
| 3,024,020 | 3/1962 | Alton | 434/258 X |
| 3,419,732 | 12/1968 | Lane | 272/93 X |
| 3,523,374 | 8/1970 | Schuster | 434/69 |
| 3,751,825 | 8/1973 | Barrett | 434/228 |
| 4,237,635 | 12/1980 | Paraghamian et al. | 40/463 |

*Primary Examiner*—William H. Grieb

*Attorney, Agent, or Firm*—Bacon & Thomas

[57] ABSTRACT

A means for presenting individual instructions from a group of predetermined instructions in a random fashion is provided by a random word generator and a binary counter which cooperate to address a programmable read-only memory which sequentially provides character forming potentials to a plurality of fluorescent character display indicators so that each indicator receives the same character forming potentials at each step in the sequence in combination with a binary decoder responsive to the binary counter for enabling only one of the indicators for each step in the sequence.

12 Claims, 3 Drawing Figures

JOINS Fig. 3

ELECTRONIC REACTION TRAINING APPARATUS

TECHNICAL FIELD

This invention relates to training devices which produce visual commands or instructions presented in a random sequence by an electronic display means to which a subject responds.

STATEMENT OF INDUSTRIAL APPLICATION

There is a need for a training or therapeutical response reaction device to develope a persons reaction response to visual commands or instructions. Such devices could be used in hospitals for physical therapy associated with the rehabilitation of patients who have experienced a variety of disfunctions due to illness, accidents or surgery. Devices of this category could also be utilized in schools for retarded children and in nursing homes whereby the reflexes of the retarded or aged are stimulated, trained or retrained to compensate for lack of experience of both mind and body. Devices of this nature are also need by neurologists, orthopedic specialists, and by physicians who must test a patient's mind and body correlation. Devices of this type are also useful in athletic fields to increase the quickness of reaction of athletes.

BACKGROUND OF PRIOR ART

Some attempts have been made to provide reaction response training devices to fit the above needs and many have met with moderate success. For instance, W. Alton in U.S. Pat. No. 3,024,020 proposes an apparatus for testing agility and powers of coordination. In this system, the person utilizing the apparatus attempts to place a limb in a predetermined position as directed by a light stimulus. Rowland in U.S. Pat. No. 1,564,138 discloses a testing apparatus which provides a similar response reflex type of coordination measuring means in which the operator must manually manipulate an object in response to a light display. Systems such as these provide a basic visual cue/reaction but the required physical action is minimal and limited.

Brown in U.S. Pat. No. 2,260,432 and Schuster in U.S. Pat. No. 3,523,374 disclose vehicle training aids wherein an operator actuates vehicle controls in response to visual cues. Here, additional physical actions are required by the test subject and in some instances a deeper thought process is required prior to the action than in the preceding examples of reaction response machines. However, systems such as these still fail to provide a means whereby selected muscles of the body may be exercised in a reaction response mode.

Ranseen in U.S. Pat. No. 2,678,692 presents a coordination measuring device wherein coordination between stimulation and reaction of a test subject is measured. This system contemplates a visual stimulation but limits that stimulation to extremely simple presentations which therefore limit the possible ranges of response reaction that are required to meet the needs set forth above.

A copending patent application by the present inventor, Ser. No. 782,024, now U.S. Pat. No. 4,237,635, issued Dec. 9, 1980, on "Reaction Training Apparatus" attempts to meet many of the needs not satisfied by the prior art. In the copending application a display means is provided which will identify various parts of a test subject's body and a second display means is provided which will request a specific movement of that part of the body. In this device, two displays provided by words printed on endless belts that may be randomly driven and periodically stopped for predetermined periods of time are integrated to create the required stimulus. This system while meeting many of the needs not satisfied by the prior art, is limited in that only a few commands are available due to the physical limitations of the endless belts. The system suffers additional disadvantages in that it cannot change displays or commands instantly due to the transport time required by the belts.

OBJECTIVES OF THE INVENTION

In view of the preceding, it is a primary objective of the present invention to provide a reaction response device capable of randomly presenting a large variety of visual commands at a predetermined repetition rate with a predetermined display retentivity.

A further objective of the present invention is to provide a reaction response device utilizing a luminous visual display responsive to an electronic memory system adapted to cause random generation of predetermined commands.

A still further objective of the present invention is to provide a word display for mind and body reaction which includes a random number generator which causes solid state programmable read-only memory means to produce a group of parallel voltage levels that result in activation of a fluorescent display means for creating alpha-numeric characters which form preselected words.

Other objectives of the present invention which will become obvious in light of the specification, drawings and claims which follow are anticipated.

SUMMARY OF THE INVENTION

The reaction response display generating system which is the present invention includes a random number generator adapted to produce a five bit word. The five bit word is applied to a programmable read-only memory preprogrammed to provide a series of fourteen bit parallel words that drive the fourteen anodes of each of fifteen fluorescent character displays interconnected in parallel. A 0 through 15 step binary counter steps the programmable read-only memory through fifteen row addresses which result in a sequence of fifteen character creating output words from the programmable read-only memory in response to the five bit column address word from the random number generator. The binary counter which sequences the programmable read-only memory through the fifteen row addresses simultaneously sequences a fifteen step decoder which sequentially enables the fifteen fluorescent character displays in a mutually exclusive fashion by providing control grid voltages via a buffer means.

As explained above, the fifteen fluorescent character displays are sequentially energized to spell predetermined command word groups in a random fashion. The binary counter which sequentially causes the activation of each individual character forming the word groups is driven by a scan frequency generator which has a repetition rate that is at least fifteen times faster than the extinguishing rate of the fluorescent character displays so that the visual impression provided by the system is one wherein all characters forming the word groups appear to be constantly illuminated. A display timer is included in the system and it provides a reset function whereby the random number generator is reset and caused to produce a new five bit word after a predetermined display time which may be varied to meet user needs. The display timer also resets the binary counter in addition to resetting the random number generator to ensure that the binary decoder begins enabling individual characters simultaneously with the sequencing of the programmable read-only memory row addresses.

DETAILED DESCRIPTION OF THE INVENTION

Figure 1:
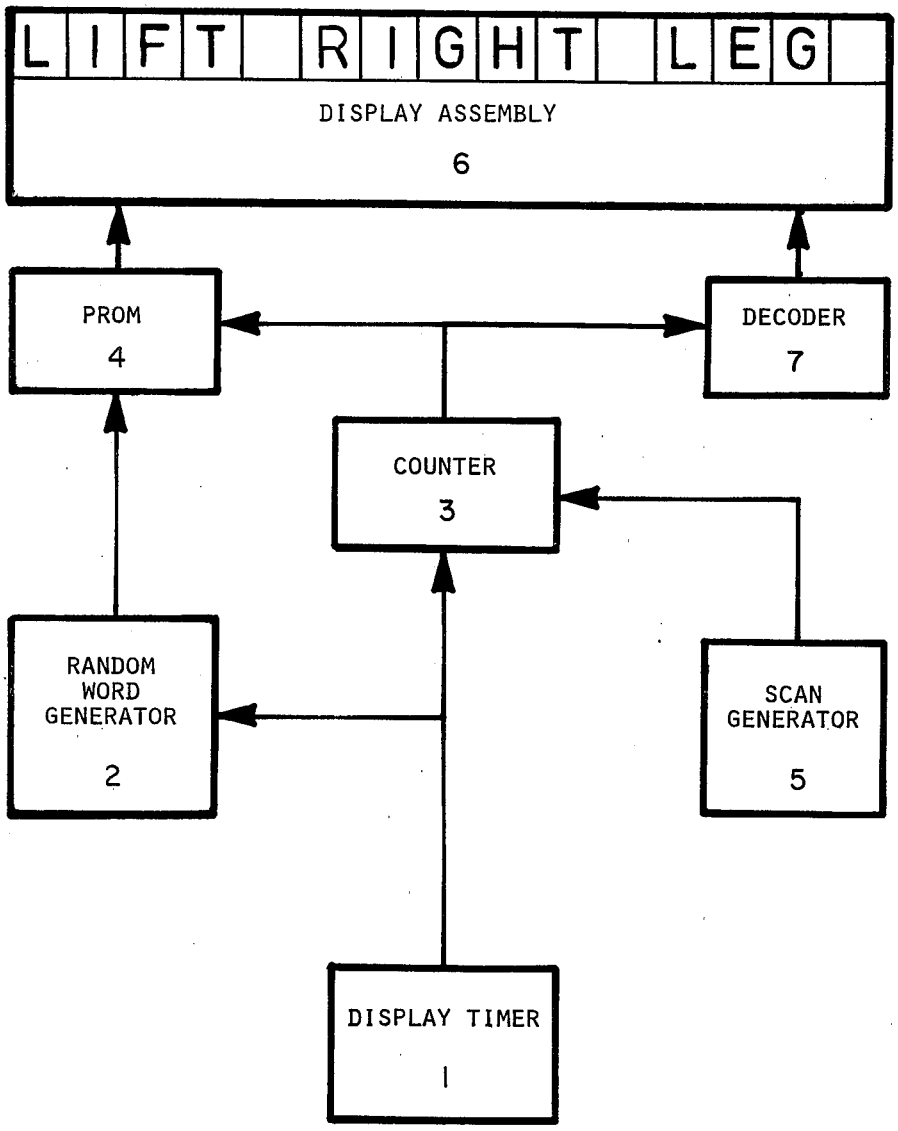
FIG. 1 is a block diagram illustrating the interconnection of the primary subsystems of the reaction response display generating system.

The block diagram of FIG. 1 illustrates the basic subsystems of the subject invention. The display timer 1 provides periodic reset pulses to both the random generator 2 and counter 3 which provide column and row addressing respectively to the programmable read-only memory 4. A scan generator 5 increments counter 3 which sequentially steps through fifteen positions and causes the programmable read-only memory 4 to step through fifteen row addresses while simultaneously sequentially enabling each character display of the fifteen character display assembly 6 via decoder 7.

The frequency of the scan generator 5 is sufficiently rapid so that the fifteen characters in display assembly 6 appear to be simultaneously illuminated due to the rapid stepping through the programmable read-only memory and decoder. After a predetermined interval, the display timer 1 resets the random generator 2 and counter 3. This causes new row addresses to be provided to the programmable read-only memory and a new command is thus generated seemingly instantaneously to an observer.

Figure 2:
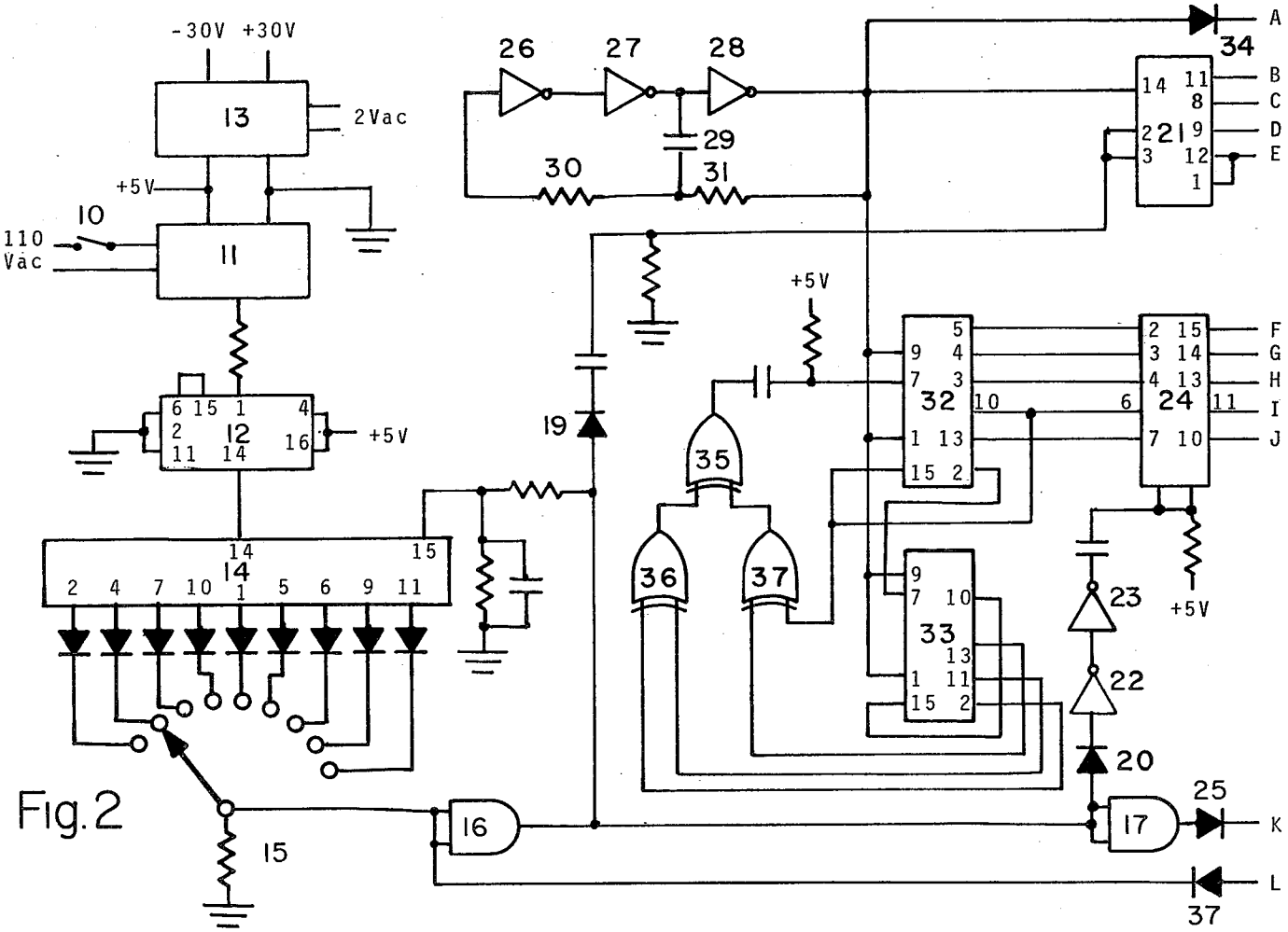
FIG. 2 is a schematic diagram illustrating in detail the memory addressing circuitry of the subject invention.

The display timer 1 of FIG. 1 is comprised of a plurality of counters adapted to function as dividers of a power source, the interconnection of which may be seen in FIG. 2. When the system is turned on by closure of on-off switch 10, 110 volts alternating current is applied to power supply 11. Power supply 11 converts the 110 volt, 60 cycle AC to a 60 cycle pulse train, and a positive 5 volts DC. The positive 5 volts is used as a B+ voltage the the various integrated circuits comprising the invention. Power supply 11 also couples current to power supply 13 which generates the two volt AC filament voltages required by the fluorescent character displays 6 of FIG. 1 and the positive and negative 30 volt DC potentials required for proper operation of those devices.

In a preferred embodiment, power supply 11 is a single output power supply such as model number P5-1 manufactured by OEM. This power supply provides a 5 volt DC output as previously suggested to the various integrated circuits of the system and to power supply 13 which, in a preferred embodiment is a C-2 converter produced by TKC Corporation of America at 2041 Rosecrans Ave., El Segundo, Calif. This converter produces a floating AC voltage across a transformer secondary which is rectified to produce a positive and negative 30 volt potential for the fluorescent displays. A two volt AC output is also provided by the transformer secondary to power the filaments of the displays.

Power supply 11 of FIG. 2 includes a step down transformer which provides a low voltage AC to rectifying elements adapted to provide the five volt regulated DC output. In addition to providing the required DC potential to the rectifiers, the step down transformer provides a low voltage 60 cycle signal that normally is not used but in the present invention it is coupled to divider 12. Divider 12, in a preferred embodiment is a type MC14566B industrial time base generator which includes a divide by 10 ripple counter in series with a divide by 6 ripple counter to create a divide by 60 circuit that changes the 60 cycle input from power supply 11 to a continuous pulse train having a repetition rate of one pulse per second.

The one pulse per second output of time base generator or divider 12 is applied to divider 14 which is, in a preferred embodiment, a type MC14017B decade counter/divider which provides outputs that are normally low but go high at their appropriate decimal time period. These outputs are coupled via isolating diodes 18 to contact pads on the time selector switch 15. Thus, dependent upon the position of the wiper arm of switch 15, a high logic level will be applied to both inputs of AND gate 16 every one to nine seconds. It should be understood, that various embodiments may be provided wherein switch 15 contains contact pads for less than the total number of outputs provided by counter/divider 14 and thereby reduce the possible repetition rate selection available in the system. In a preferred embodiment, AND gate 16 is a type 74LS08 two-input AND gate provided in a quad package which also provides AND gates 17 of FIG. 2.

AND gates 16, 17 and 71 are positive-logic AND gates and normally provide a negative or low logic level output. However, when both inputs are high, the output goes high. Thus, whenever the selected output of decade counter/divider 14 goes high, a high logic level is created at the output of AND gate 16. This high logic level is coupled via diode 19 to the reset inputs of binary counter 21 and via diode 20 and inverters 22 and 23 to the reset input of latch 24. The high logic level output of AND gate 16 is also applied to both inputs of AND gate 17 which produces a high logic level that is coupled via diode 25 to the reset inputs of programmable read-only memories 41 and 42 of FIG. 3.

Binary counter 21, in a preferred embodiment, is a type 74LS93 four bit binary ripple counter which is incremented by the scan generator 5 of FIG. 1. The scan generator 5 of FIG. 1 is illustrated in detail in FIG. 2 where it is comprised of inverters 26, 27 and 28 and the RC feedback network including capacitors 29 and resistors 30 and 31. Inverters 26 through 28 are type 74LS04 inverters provided on a hex chip which also provides inverters 22 and 23. The RC feedback network is adjusted by properly selecting the value of resistor 31 so that in combination with capacitor 29 and resistor 30 and the inverters, a pulse train is generated which has a pulse repetition rate of 100 Kilo Hertz. This causes counter 21 to sequence at a repetition rate greater than the decay time of the fluorescent displays so that an effectively continuous display is presented to a viewer as previously explained.

The output inverter 28 of the scan generator applies clock pulses to binary counter 21, shift registers 32 and 33 and via diode 34 to the chip enable inputs of programmable read-only memories 41 and 42.

Shift registers 32 and 33 are each dual four bit static shift registers of the type MC14015B. These shift registers are simultaneously clocked by the output of inverter 28 of the scan generator and shift register 32 provides a pseudo random output to latch 24 as a function of the feedback data inputs to all four individual registers comprising shift registers 32 and 33 as illustrated in FIG. 2. In FIG. 2 note that the upper half of shift register 32 is incremented during the positive going clock transition as a function of the output of exclusive OR gate 35 which is responsive to the outputs of exclusive OR gates 36 and 37 which are responsive to an output of the upper register of shift register 32 and selective outputs of the lower register of shift register 33.

The exclusive NOR gates 35 through 37 are provided in a preferred embodiment by the quad exclusive OR gate integrated circuit type MC14070B which functions that when one but not both inputs are high, the output is high but when both inputs are high or both inputs are low, the output is low. Thus, the five outputs of shift register 32 which are applied to latch F are constantly shifted in a pseudo random fashion so that at any given instant the parallel inputs to latch 24 will be a random combination ranging from all high logic levels to all low logic levels with any combination in between equally probable.

Latch 24 is a 7496 five bit shift register which is parallel loaded immediately following the display timer reset pulse provided via inverter 23. Once set, the five registers comprising latch 24 remain set until cleared by a reset pulse from the display timer and since the parallel loading function is enabled, the latch is immediately set as a function of the random input from register 32.

Figure 3:
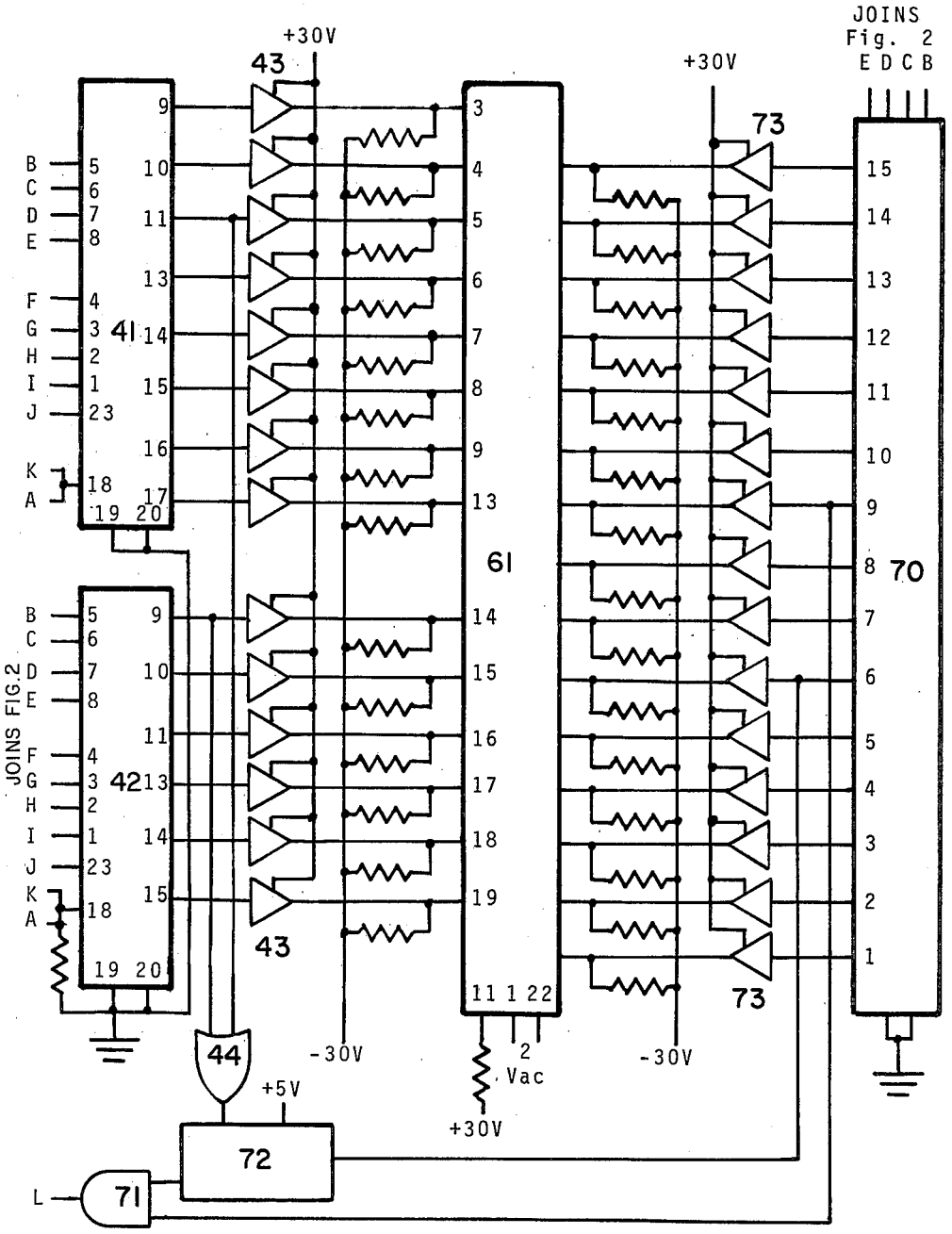
FIG. 3 is a schematic diagram of the display generating circuitry of the present invention.

Programmable read-only memories 41 and 42 of FIG. 3 are 1024X8 ultraviolet erasable programmable read-only memories of the type MSM2758 such as manufactured by OKI. They each provide a 1,024 bit by eight bit organization with inputs from binary counter 21 to input pins 8, 10, 11 and 13 providing sequential row addressing as a function of the stepping of binary counter 21 immediately following the reset signal from the display timer applied via diode 25 to the chip enable at pins 18. The random five bit word from latch 24 is applied to the column address inputs via pins 1, 2, 3, 4 and 23 of both programmable read-only memories 41 and 42. These columns contain the logic functions for the fifteen characters as rows are selectively enabled for read out by the input from the binary counter 21. As the rows are made available for read out, they form a fourteen bit parallel word coupled from programmable read-only memories 41 and 42 through buffer amplifiers 43 which in a preferred embodiment are comprised of a series of parallel amplifiers in a type DI-514 integrated circuit as manufactured by Dionics Incorporated of 65 Rushmoore St., Westbury, N.Y. Each of the fourteen buffer amplifiers 43 are connected to an individual bus in the display assembly which is connected to a common anode in each of the fifteen fluorescent character displays in the fluorescent character display assembly 61. Each individual fluorescent character display includes fourteen anodes which generate a standard fourteen bar display when enabled by a proper potential applied to the tube grid. The enabling potentials for each of the fifteen displays of the fluorescent character display assembly 61 are provided by binary decoder 70 which is a type 74154 in a preferred embodiment. Binary decoder 70 receives the four bit binary word from binary counter 21 and in response thereto sequentially provides a mutually exclusive low level output on pins 1 through 15 which are coupled via buffer amplifiers 73 to control grids of individual ones of the fifteen fluorescent character display tubes. Buffer amplifiers 73 are similar to buffer amplifiers 43 in that they are a type DI-514 integrated circuit in a preferred embodiment.

An activity sensor check circuit is illustrated in FIG. 3 which ensures that latch 24 will be reset to a new word in the event the programmable read-only memories fail to produce an output on two of their fourteen output lines. This circuit is comprised of flip-flop 72, OR gate 44 and AND gate 71. Flip-flop 72 is a 74LS74D-type flip-flop which is a positive-edge-clocked flip-flop which applies a low logic level to AND gate 71 except when the output of OR gate 44 transitions from a low level to a high level which results in the event that an output from programmable read-only memory 41 or 42 goes high while the other output from the programmable read-only memories remains low and binary decoder 70 has decoded a decimal 6 to place a low level on the reset input of flip-flop 72. With the preceding requirements met, if the binary decoder is set on any decimal value other than 9, AND gate 71 will be trued and a positive potential or high logic level will be coupled via diode 37 to AND gate 16. This will cause AND gate 16 to function as if the display timer has timed out and the binary counter 21, latch 24 and programmable read-only memories 41 and 42 will be reset. Thus the circuit functions to look at pulses from the programmable read-only memories which will fire OR gate 44 which, in turn, sets flip-flop 72. The grid pulses reset the flip-flop and thus if OR gate 44 sees no pulses which indicate a failure from the programmable read-only memories, the flip-flop 72 will not set and a low level remains at the output of flip-flop 72 connected to AND gate 71 when decimal 6 from decoder 70 attempts to reset flip-flop 72. When decoder 70 advances to decimal 9, AND gate 71 will go high resetting the system via diode 37 and AND gate 60 as previously explained and a new display of words will be immediately presented as the result of a bit character failure.

Once energized, the system continues to function by randomly displaying command word groups at a repetition rate which is a function of the display timer switch 15 until power is removed from the system.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What I claim is:

1. A display generator, comprising:

a programmable read-only memory, including addressable data;

random word generator means for addressing said memory;

counter means for addressing said memory; a plurality of character display means for producing alphanumeric displays as a function of said memory addressable data; and decoder means responsive to said counter for enabling said plurality of character display means to provide a random, visual instruction.

2. A display generator as defined in claim 1, wherein said decoder enables individual ones of said plurality of character displays mutually exclusively in a repetitive sequence.

3. A display generator as defined in claim 2, further comprising a scan generator for incrementing said counter and said random word generator.

4. A display generator as defined in claim 3, further comprising a display timer means for periodically resetting said random word generator and said counter.

5. A display generator as defined in claim 4, wherein said random word generator includes:

a plurality of first shift registers simultaneously clocked by said scan generator and each having a data input from a different one of said first shift registers; and a plurality of second shift register means electronically set by said first shift registers following said reset by said display timer for producing a parallel word for addressing said memory.

6. A display generator as defined in claim 1 wherein said memory is a programmable read-only memory and said addressable data is arranged in column and row format;

said random word generator addresses said memory columns; and said counter addresses said memory rows.

7. A display generator as defined in claim 3 wherein said counter is a binary counter for producing a four bit word.

8. A display generator as defined in claim 7 wherein said character display means are fluorescent character displays each including a plurality of anodes and a control grid.

9. A display generator as defined in claim 8 wherein said like anodes of said plurality of character display means are connected in parallel and to different addresses of said memory means.

10. A display generator as defined in claim 9 wherein said decoder is a binary decoder for providing an individual output to said control grid of each of said character display means in a mutually exclusive fashion whereby individual ones of said plurality of character display means are caused to provide a display as a function of said addressable data on said anodes.

11. A method for providing a display, including the steps of:

generating a continuous sequence of pulses;

generating a random word in response to said continuous sequence of pulses;

enabling a plurality of row addresses in a programmable read-only memory with said random word;

counting said sequence of pulses with a binary counter;

sequentially addressing the columns of said programmable read-only memory by said binary counter;

providing character forming potentials to a plurality of individual alpha-numeric display generators as a function of the row and column address selected in said programmable read-only memory; and sequentially enabling individual ones of said display indicators by decoding the output of said binary counter and as a function of said decoded output applying an enabling potential to each of said indicators in sequence in a mutually exclusive fashion so as to randomly display visual instructions.

12. A method of providing a display as defined in claim 11 wherein said sequence of pulses occurs at a repetition rate which causes activation of the individual display indicators at a repetition rate which is greater than their display decay rate so that each individual character appears to be energized constantly.

* * * * *